US006473976B1

(12) United States Patent
Cocchiarella

(10) Patent No.: US 6,473,976 B1
(45) Date of Patent: Nov. 5, 2002

(54) SHARPENER FOR A PENCIL AND BEING POWERED BY A ROTARY TOOL

(76) Inventor: Guy A. Cocchiarella, 41-08 247th St., Little Neck, NY (US) 11363

( * ) Notice: Subject to any disclaimer, the term of this patent is extended or adjusted under 35 U.S.C. 154(b) by 0 days.

(21) Appl. No.: 09/884,547

(22) Filed: Jun. 19, 2001

(51) Int. Cl.[7] ..... B43L 23/00
(52) U.S. Cl. ..... 30/453; 30/500
(58) Field of Search ..... 30/500, 453–455, 30/451; 144/28.11, 28.72, 28.4; 401/50, 51

(56) References Cited

U.S. PATENT DOCUMENTS 5,379,817 A * 1/1995 O'Neil et al. ..... 30/453 X
5,394,613 A 3/1995 Ku ..... 30/454
5,727,323 A 3/1998 Cerrato ..... 30/459
6,065,514 A 5/2000 New

* cited by examiner

*Primary Examiner*—Douglas D. Watts
(74) *Attorney, Agent, or Firm*—Richard L. Miller

(57) ABSTRACT

A rotary tool powered pencil sharpener. The sharpener includes a housing, a shaft, and sharpening apparatus. The shaft extends into the housing and is rotated by the rotary tool. In a first embodiment, the sharpening apparatus includes a bracket disposed in the housing and rotating with the shaft, a support extending in the bracket, and a blade extending along the support. In a second embodiment, the sharpening apparatus includes a ring gear attached in, and to, the housing, a tube disposed in the hauling, extending from the shaft, and receiving the pencil, a cutter rotating relative to the tube, and a planet gear attached to the cutter and engaging the ring gear. The cutter has blades extending spirally therealong and rotates as the planet gear rotates around the ring gear when the tube, via the shaft, is rotated by the rotary tool, and as a result thereof, sharpens the pencil.

32 Claims, 1 Drawing Sheet

SHARPENER FOR A PENCIL AND BEING POWERED BY A ROTARY TOOL

BACKGROUND OF THE INVENTION

1. Field of the Invention

The present invention relates to a sharpener for a pencil. More particularly, the present invention relates to a sharpener for a pencil and being powered by a rotary tool.

2. Description of the Prior Art

Numerous innovations for pencil sharpeners have been provided in the prior art that will be described. Even though these innovations may be suitable for the specific individual purposes to which they address, however, they differ from the present invention.

A FIRST EXAMPLE, U.S. Pat. No. 5,394,613 to Ku teaches a spring-driven pencil sharpener including a top cap having a top opening to receive a pencil and two corresponding slots to receive a fastening device including a couple of hollow frames, a housing which is constructed with a pair of coupling castings, each of which being accompanied by a lateral cover, for disposing a pencil blade set and a spring-driven powering device and the outline of the housing is preferably designed to cooperate with that of the cap to form an egg-like shape for being held comfortably as well as looking nice.

A SECOND EXAMPLE, U.S. Pat. No. 5,727,323 to Cerrato teaches a pencil sharpener including a body member having a bottom surface with a first predetermined configuration, a top surface with a second predetermined configuration, and a recess in the top surface extending from a periphery of the body member across a portion of the body member, a blade mounted to the tap surface of the body member adjacent an upper edge of the recess so as to enable sharpening of a pencil, and adhesive provide at the bottom surface of the body member for selectively fastening the body member to another article.

A THIRD EXAMPLE, U.S. Pat. No. 6,065,514 to New teaches a portable, handheld, sharpening device for sharpening a cosmetic pencil having an outer casing of hard material and an inner casing of soft wax-like cosmetic material. The device includes a plastic housing, a steel blade for removing the outer casing of material from the cosmetic pencil while providing a tip having a radius of no larger than about ⅛" to the inner core of cosmetic material and a motor coupled to the blade to rotate the blade that is connected to at least one battery. The device is small and lightweight so that it can conveniently be stored in a pocket or a purse.

It is apparent that numerous innovations for pencil sharpeners have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a sharpener for a pencil and being powered by a rotary tool that avoids the disadvantages of the prior art.

ANOTHER OBJECT of the present invention is to provide a sharpener far a pencil and being powered by a rotary tool that is simple and inexpensive to manufacture.

STILL ANOTHER OBJECT of the present invention is to provide a sharpener for a pencil and being powered by a rotary tool that is simple to use.

BRIEFLY STATED, STILL YET ANOTHER OBJECT of the present invention is to provide a rotary tool powered pencil sharpener. The sharpener includes a housing, a shaft, and sharpening apparatus. The shaft extends into the housing and is rotated by the rotary tool. In a first embodiment, the sharpening apparatus includes a bracket disposed in the housing and rotating with the shaft, a support extending in the bracket, and a blade extending along the support. In a second embodiment, the sharpening apparatus includes a ring gear attached in, and to, the housing, a tube disposed in the housing, extending from the shaft, and receiving the pencil, a cutter rotating relative to the tube, and a planet gear attached to the cutter and engaging the ring gear. The cutter has blades extending spirally therealong and rotates as the planet gear rotates around the ring gear when the tube, via the shaft, is rotated by the rotary tool, and as a result thereof, sharpens the pencil.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

First Embodiment

Figures 1, 2, 3:
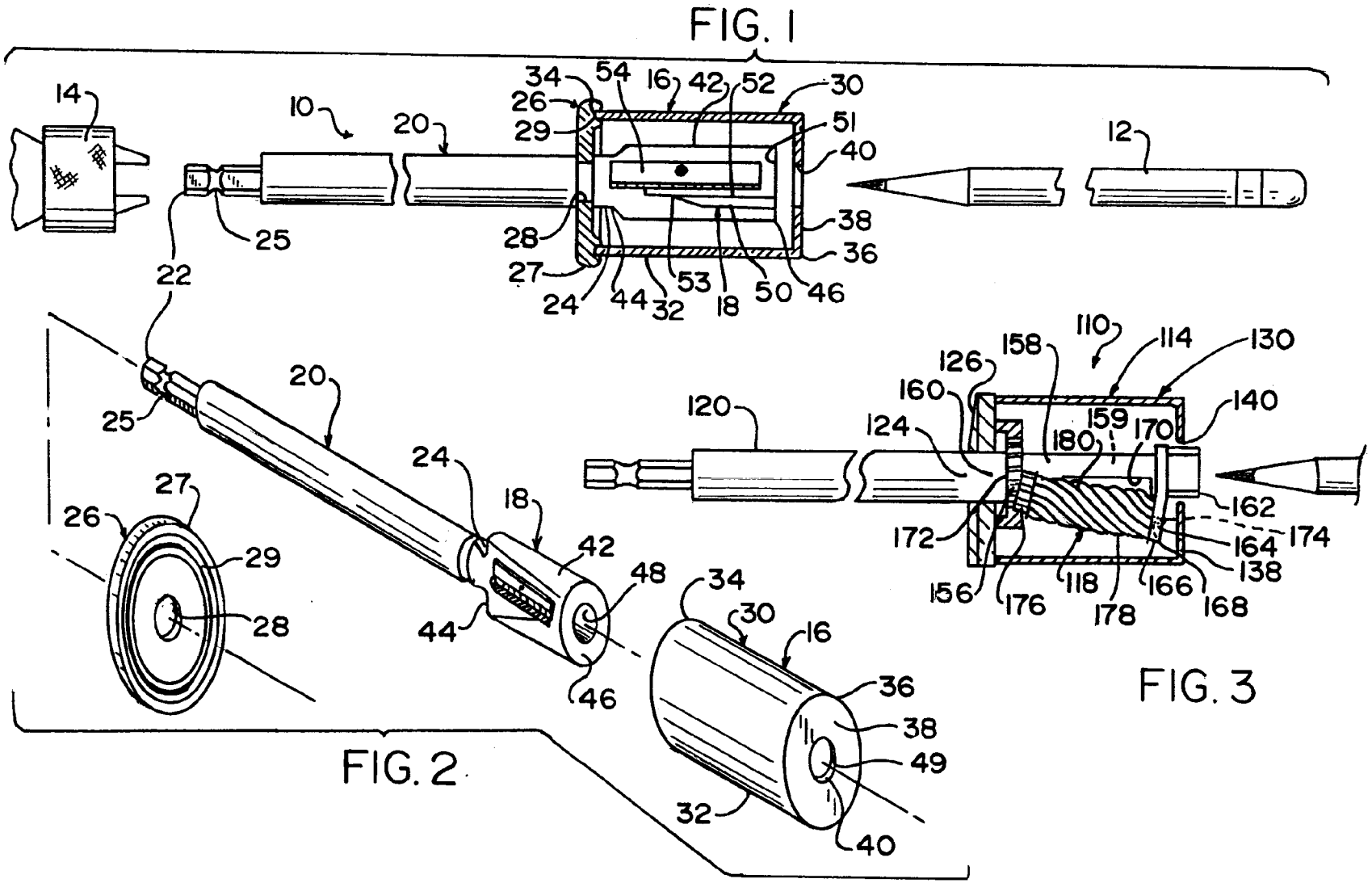
FIG. 1 is a diagramatic side elevational view, in partial section, of a first embodiment of the present invention in use.
FIG. 2 is a diagrammatic exploded perspective view of the of the first embodiment of the present invention shown in FIG. 1.
FIG. 3 is a diagrammatic side elevational view, in partial section, of a second embodiment of the present invention in use.

10 sharpener of present invention for pencil 12 and being powered by rotary tool 14

12 pencil

14 rotary tool

16 housing for holding shavings (not shown) of pencil 12 when being sharpened

18 sharpening apparatus for sharpening pencil 12

20 shaft

22 external end of shaft 20 for engaging and rotating with rotary tool 14

24 internal end of shaft 20

25 recess extending circumferentially around external end 22 of shaft 20 for engaging ball (not shown) of electric screwdriver (not shown) of rotary tool 14

26 disk of housing 16

27 periphery of disk 26 of housing 16

28 throughbore centrally through disk 26 of housing 16

29 recess extending circumferentially around disk 26 of housing 16

30 body of housing 16 for holding shavings (not shown) of pencil 12 when being sharpened

32 side wall of body 30 of housing 16

34 proximal end of side wall 32 of body 30 of housing 16

36 distal end of side wail 32 of body 30 of housing 16

38 end wall of body 30 of housing 16

40 throughbore extending centrally through end wall 38 of body 30 of housing 18 for receiving pencil 12

42 bracket of sharpening apparatus 18

44 proximal end of bracket 42 of sharpening apparatus 18

46 distal end of bracket 42 of sharpening apparatus 18

48 throughbore extending centrally through distal end 46 of bracket 42 of sharpening apparatus 18

49 perimeter defining throughbore 48 extending centrally through distal end 46 of bracket 42 of sharpening apparatus 18

50 support of sharpening apparatus 18 for receiving pencil 12 extending through throughbore 48 in distal end 46 of bracket 42

51 base of support 50 of sharpening apparatus 18

52 throughslot extending axially along the support 50 of sharpening apparatus 18 for allowing shavings (not shown) from pencil 12 being sharpened to pass therethrough

53 apex of support 50 of sharpening apparatus 18

54 blade of sharpening apparatus 18 for sharpening pencil 12 as bracket 42 of sharpening apparatus 18 is rotated by rotary tool 12, via shaft 20

Second Embodiment

110 sharpener

114 housing

118 sharpening apparatus

120 shaft

124 internal end of shaft 120

126 disk of housing 114

130 body of housing 114

138 end wall of body 130 of housing 116

140 throughbore in end wall 138 of body 130 of housing 116

156 ring gear of sharpening apparatus 118

158 tube of sharpening apparatus 118

159 hollow interior contained in tube 158 of sharpening apparatus 118

160 proximal end of tube 158 of sharpening apparatus 118

162 distal end of tube 158 of sharpening apparatus 118 for receiving pencil 12

164 tab of sharpening apparatus 118

166 distal end of tab 164 of sharpening apparatus 118

168 throughbore through distal end 166 of tab 164 of sharpening apparatus 118

170 notch in tube 158 of sharpening apparatus 118 for exposing pencil 12 received through distal end 162 of tube 158 in body 130 of housing 114

172 blindbore in proximal end 160 of tube 158 of sharpening apparatus 118

174 axle of sharpening apparatus 118

176 planet gear of sharpening apparatus 118

178 cutter of sharpening apparatus 118

180 blades of cutter 178 of sharpening apparatus 118 for sharpening pencil 12 as tube 158 of sharpening apparatus 118, via shaft 120, is rotated by rotary tool 14

DETAILED DESCRIPTION OF THE PREFERRED EMBODIMENT

Referring now to the figures, in which like numerals indicate like parts, and particularly to FIG. 1, a first embodiment of the sharpener of the present invention is shown generally at 10 for a pencil 12 and being powered by a rotary tool 14.

The configuration of the sharpener 10 can best be seen in FIGS. 1 and 2, and as such, will be discussed with reference thereto.

The sharpener 10 comprises a housing 16 for holding shavings (not shown) of the pencil 12 when being sharpened, and a sharpening apparatus 18 for sharpening the pencil 12.

The sharpener 10 further comprises a shaft 20 that extends rotatably into the housing 16.

The shaft 20 is slender and elongated.

The shaft 20 has an external end 22 that is external of the housing 16 and is for engaging and rotating with the rotary tool 14, and an internal end 24 that is internal to the housing 16 and is operatively connected to the sharpening apparatus 18.

The external end 22 of the shaft 20 has a recess 25 that extends circumferentially therearound, and when the rotary tool 14 is an electric screwdriver (not shown), is for engaging the ball (not shown) thereof.

The housing 16 comprises a disk 26 that has a throughbore 28 that extends centrally therethrough and a periphery 27.

The disk 26 further has a recess 29 that extends circumferentially therearound, just inboard of, and concentric with, the periphery 27 of the disk 26.

The disk 26 is perpendicular to, and concentric with, the shaft 20.

The shaft 20 extends into the throughbore 28 in the disk 26, with the disk 26 being in proximity of the internal end 24 of the shaft 20, and with the recess 29 in the disk 26 facing the internal end 24 of the shaft 20.

The housing 16 further comprises a body 30 that is attached to the disk 26 for holding the shavings (not shown) of the pencil 12 when being sharpened.

The body 30 of the housing 16 is replaceably attached to the disk 26, and when removed therefrom, allows for removal of the shavings (not shown) therefrom.

The body 30 of the housing 16 is cylindrically-shaped and hollow.

The body 30 of the housing 16 has a side wall 32 that is cylindrically-shaped and extends, at a proximal end 34 thereof, replaceably and coaxially from the recess 29 in the disk 26, to a distal end 36.

The proximal end 34 of the side wall 32 of the body 30 of the housing 16 is snap fitted into the recess 29 in the disk 26 of the housing 16 so as to be readily removable therefrom for removal of the shavings (not shown) from the body 30.

The body 30 of the housing 16 further has an end wall 38 that is disk-shaped and fixedly closes the distal end 36 of the body 30 of the housing 16.

The end wall 38 of the body 38 of the housing 16 is perpendicular to the side wall 32 of the body 30 and is parallel to the disk 26 of the housing 16.

The end wall 38 of the body 30 of the housing 16 has a throughbore 40 that extends centrally therethrough and is far receiving the pencil 12.

The throughbore 40 in the end wall 38 of the body 30 of the housing 16 is in alignment with the throughbore 28 in the disk 26 of the housing 16.

The sharpening apparatus 18 includes a bracket 42 that extends, at a proximal end 44 thereof, coaxially from, and rotates with, the internal end 24 of the shaft 20 to a distal end 46.

The distal end 46 of the bracket 42 is disk-shaped and has a throughbore 48 that extends centrally therethrough and is defined by a perimeter 49.

The throughbore 48 in the distal end 46 of the bracket 42 is in alignment with the throughbore 40 in the end wall 38 of the body 30 of the housing 16 for receiving the pencil 12 extending through the throughbore 40 in the end wall 38 of the body 30 of the housing 16.

The sharpening apparatus 18 further includes a support 50 that is conically-shaped, hollow, and extends, at a base 51 thereof, coaxially from the perimeter 49 defining the throughbore 48 in the distal end 46 of the bracket 42, towards the proximal end 44 of the bracket 42, to an apex 53 thereof, and is for receiving the pencil 12 extending through the throughbore 48 in the distal end 46 of the bracket 42.

The support 50 has a throughslot 52 that extends axially therealong from the base 51 thereof to the apex 53 thereof and is for allowing shavings (not shown) from the pencil 12 being sharpened to pass therethrough.

The sharpening apparatus 18 further includes a blade 54 that is flat, extends axially along the support 50, and communicates with the throughslot 52 in the support 50 for sharpening the pencil 12 as the bracket 42 is rotated by the rotary tool 12, via the shaft 20.

The configuration of a second embodiment of the sharpener 110 can best be seen in FIG. 3, and as such, will be discussed with reference thereto.

The sharpener 110 is similar to the sharpener 10, except for the sharpening apparatus 118.

The sharpening apparatus 118 comprises a ring gear 156 that is coaxially and fixedly attached to the disk 126 of the housing 114 and faces into the body 130 of the housing 114.

The sharpening apparatus 118 further comprises a tube 158 that contains a hollow interior 159 and extends, at a proximal end 160 thereof, coaxially from, and rotates with, the internal end 124 of the shaft 120, to a distal end 162 thereof that extends rotatably into the throughbore 140 in the end wall 138 of the body 130 of the housing 116 and is for receiving the pencil 12.

The sharpening apparatus 118 further comprises a tab 164 that extends radially outwardly from the tube 158 to a distal end 165, and is disposed just inboard of the distal end 162 of the tube 158 and in the body 130 of the housing 114.

The distal end 166 of the tab 164 has a throughbore 168 that extends therethrough.

The tube 158 further has a notch 170 that communicates with the hollow interior 159 of the tube 158, extends axially from the tab 164 to the proximal end 160 of the tube 158, is for exposing the pencil 12 received through the distal end 162 of the tube 158, and exposes the throughbore 168 in the distal end 166 of the tab 164.

The proximal end 160 of the tube 158 has a blindbore 172 that extends horizontally therein and communicates with the notch 170 in the tube 158.

The sharpening apparatus 118 further comprises an axle 174 that extends, at one end thereof, rotatably in the blindbore 172 in the proximal end 168 of the tube, to rotatably in, at the other end thereof, the throughbore 168 in the distal end 166 of the tab 164.

The sharpening apparatus 118 further comprises a planet gear 176 that is disposed on the one end of the axle 174 and engages the ring gear 156 so as to rotate around the ring gear 156 when the tube 158, via the shaft 120 is rotated by the rotary tool 12.

The sharpening apparatus 118 further comprises a cutter 178 that is cylindrically-shaped and extends from, and rotates relative to, the tab 164 to, and rotates with, the planet gear 176 so as to rotate as the planet gear 156 rotates around the ring gear 156 when the tube 158, via the shaft 120, is rotated by the rotary tool 14.

The cutter 178 has blades 180 that extend spirally therealong from the one end thereof to the other end thereof and communicate with the notch 170 in the tube 158 for sharpening the pencil 12 as the tube 158, via the shaft 120, is rotated by the rotary tool 14.

It will be understood that each of the elements described above, or two or more together, may also find a useful application in other types of constructions differing from the types described above.

While the invention has been illustrated and described as embodied in a sharpener for a pencil and being powered by a rotary tool, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A sharpener for a pencil and being powered by a rotary tool, comprising:

a) a housing for holding shavings of the pencil when being sharpened; and b) means for sharpening the pencil;

wherein said housing is for holding shavings of the pencil when being sharpened; further comprising a shaft; and wherein said shaft extends rotatably into said housing, wherein said shaft has an external end;

wherein said external end of said shaft is external of said housing;

wherein said external end of said shaft is for engaging and rotating with the rotary tool;

wherein said shaft has an internal end;

wherein said internal end of said shaft is internal to said housing; and wherein said internal end of said shaft is operatively connected to said means.

2. The sharpener as defined in claim 1, wherein said shaft is slender; and wherein said shaft is elongated.

3. The sharpener as defined in claim 1, wherein said external end of said shaft has a recess;

wherein said recess extends circumferentially around said external end of said shaft; and wherein said recess in said external end of said shaft is for engaging the ball of an electric screwdriver when the rotary tool is an electric screwdriver.

4. The sharpener as defined in claim 1, wherein said housing comprises a disk;

wherein said disk of said housing has a throughbore;

wherein said throughbore extends centrally through said disk of said housing; and wherein said disk of said housing has a periphery.

5. The sharpener as defined in claim 4, wherein said disk of said housing has a recess;

wherein said recess extends circumferentially around said disk of said housing;

wherein said recess is just inboard of said periphery of said disk of said housing; and wherein said recess is concentric with said periphery of said disk of said housing.

6. The sharpener as defined in claim 4, wherein said disk of said housing is perpendicular to said shaft; and wherein said disk of said housing is concentric with said shaft.

7. The sharpener as defined in claim 4, wherein said shaft extends into said throughbore in said disk of said housing;

wherein said disk is in proximity of said internal end of said shaft; and wherein said recess in said disk faces said internal end of said shaft.

8. The sharpener as defined in claim 5, wherein said housing comprises body;

wherein said body of said housing is attached to said disk; and wherein said body of said housing is for holding shavings of the pencil when being sharpened.

9. The sharpener as defined in claim 8, wherein said body of said housing is replaceably attached to said disk, and when removed therefrom, allows for removal of the shavings therefrom.

10. The sharpener as defined in claim 8, wherein said body of said housing is cylindrically-shaped; and wherein said body of said housing is hollow.

11. The sharpener as defined in claim 8, wherein said body of said housing has a side wall;

wherein said side wall of said body of said housing is cylindrically-shaped;

wherein said side wall of said body of said housing extends, at a proximal end thereof, replaceably from said recess in said disk of said housing, to a distal end; and wherein said side wall of said body of said housing extends at said proximal end thereof coaxially from said recess in said disk of said housing.

12. The sharpener as defined in claim 11, wherein said proximal end of said side wall of said body of said housing is snap fitted into said recess in said disk of said housing so as to be readily removable therefrom for removal of shavings from said body of said housing.

13. The sharpener as defined in claim 11, wherein said body of said housing has an end wall;

wherein said end wall of said body of said housing is disk-shaped; and wherein said end wall of said body of said housing fixedly closes said distal end of said body of said; housing.

14. The sharpener as defined in claim 13, wherein said end wall of said body of said housing is perpendicular to said side wall of said body; and wherein said end wall of said body of said housing is parallel to said disk of said housing.

15. The sharpener as defined in claim 8, wherein said end wall of said body of said housing has a throughbore;

wherein said throughbore extends centrally through said end wall of said body of said housing; and wherein said throughbore through said end wall of said body of said housing is for receiving the pencil.

16. The sharpener as defined in claim 15, wherein said throughbore in said end wall of said body of said housing is in alignment with said throughbore in said disk of said housing.

17. The sharpener as defined in claim 15, wherein said means includes a bracket;

wherein said bracket extends, at a proximal end thereof, coaxially from said internal end of said shaft, to a distal end; and wherein said bracket rotates with said internal end of said shaft.

18. The sharpener as defined in claim 17, wherein said distal end of said bracket is disk-shaped;

wherein said distal end of said bracket has a throughbore;

wherein said throughbore extends centrally through said distal end of said bracket; and wherein said throughbore through said distal end of said bracket is defined by a perimeter.

19. The sharpener as defined in claim 18, wherein said throughbore in said distal end of said bracket is in alignment with said throughbore in said end wall of said body of said housing; and wherein said throughbore in said distal end of said bracket is for receiving the pencil extending through said throughbore in said end wall of said body of said housing.

20. The sharpener as defined in claim 18, wherein said means includes a support;

wherein said support is conically-shaped;

wherein said support is hollow;

wherein said support extends, at a base thereof, coaxially from said perimeter defining said throughbore in said distal end of said bracket, towards said proximal end of said bracket, to an apex thereof; and wherein said support is for receiving the pencil extending through said throughbore in said distal end of said bracket.

21. The sharpener as defined in claim 20, wherein said support has a throughslot;

wherein said throughslot extends axially along said support;

wherein said throughslot extends from said base of said support to said apex of said support; and wherein said throughslot through said support is for allowing shavings from the pencil being sharpened to pass therethrough.

22. The sharpener as defined in claim 20, wherein said means includes a blade;

wherein said blade is flat;

wherein said blade extends axially along said support;

wherein said blade communicates with said throughslot in said support; and wherein said blade is for sharpening the pencil as said bracket is rotated by the rotary tool, via said shaft.

23. The sharpener as defined in claim 15, wherein said means includes a ring gear;

wherein said ring gear is coaxially attached to said disk of said housing;

wherein said ring gear is fixedly attached to said disk of said housing; and wherein said ring gear faces into said body of said housing.

24. The sharpener as defined in claim 23, wherein said means includes a tube;

wherein said tube contains a hollow interior;

wherein said tube extends, at a proximal end thereof, coaxially from said internal end of said shaft, to a distal end thereof;

wherein said distal end of said tube extends rotatably into said throughbore in said end wall of said body of said housing;

wherein said tube rotates with said shaft; and wherein said distal end of said tube is for receiving the pencil.

25. The sharpener as defined in claim 24, wherein said means includes a tab;

wherein said tab extends radially outwardly from said tube to a distal end;

wherein said tab is disposed just inboard of said distal end of said tube; and wherein said tab is disposed in said body of said housing.

26. The sharpener as defined in claim 25, wherein said distal end of said tab has a throughbore that extends therethrough.

27. The sharpener as defined in claim 26, wherein said tube has a notch;

wherein said notch in said tube communicates with said hollow interior of said tube;

wherein said notch in said tube extends axially from said tab to said proximal end of said tube;

wherein said notch in said tube is for exposing the pencil received through said distal end of said tube; and wherein said notch in said tube exposes said throughbore in said distal end of said tab.

28. The sharpener as defined in claim 27, wherein said proximal end of said tube has a blindbore;

wherein said blindbore extends horizontally in said proximal end of said tube; and wherein said blindbore in said proximal end of said tube communicates with said notch in said tube.

29. The sharpener as defined in claim 28, wherein said means includes an axle; and wherein said axle extends, at one end thereof, rotatably in said blindbore in said proximal end of said tube, to rotatably in, at the other end thereof, said throughbore in said distal end of said tab.

30. The sharpener as defined in claim 29, wherein said means includes a planet gear;

wherein said planet gear is disposed on said one end of said axle; and wherein said planet gear engages said ring gear so as to rotate around said ring gear when said tube, via said shaft, is rotated by the rotary tool.

31. The sharpener as defined in claim 30, wherein said means includes a cutter;

wherein said cutter is cylindrically-shaped;

wherein said cutter extends, at one end thereof, from said tab to, at the other end thereof, said planet gear;

wherein said cutter rotates relative to said tab; and wherein said cutter rotates with said planet gear so as to rotate as said planet gear rotates around said ring gear when said tube, via said shaft, is rotated by the rotary tool.

32. The sharpener as defined in claim 31, wherein said cutter has blades;

wherein said blades of said cutter extend spirally thereal-long from said one end thereof to said other end thereof; and wherein said blades of said cutter communicate with said notch in said tube for sharpening the pencil as said tube, via said shaft, is rotated by the rotary tool.

* * * * *